US005361667A

United States Patent [19]

Pritchard

[11] Patent Number: 5,361,667

[45] Date of Patent: Nov. 8, 1994

[54] TERMINATION FOR STRINGS OF A MUSICAL INSTRUMENT

[76] Inventor: Eric K. Pritchard, Rte. 1, Box 536, Berkeley Springs, W. Va. 25411

[21] Appl. No.: 105,920

[22] Filed: Aug. 13, 1993

Related U.S. Application Data

[63] Continuation of Ser. No. 821,068, Jan. 16, 1992, abandoned.

[51] Int. Cl.[5] ..... G10D 3/00

[52] U.S. Cl. ..... 84/297 R

[58] Field of Search ..... 84/297 S, 297 R, 199, 84/304, 305

[56] References Cited

U.S. PATENT DOCUMENTS

| | | | |
|---|---|---|---|
| 2,535,143 | 12/1950 | Kosmis, Jr. | 84/297 R |
| 2,753,749 | 7/1956 | Coupe | 84/297 R |
| 3,313,196 | 4/1967 | Mari | 84/297 S |
| 3,777,613 | 12/1973 | Chaffee et al. | 84/297 S |
| 4,164,806 | 8/1979 | Stone et al. | 84/297 S X |
| 4,453,443 | 6/1984 | Smith | 84/298 |
| 4,581,976 | 4/1986 | Ball | 84/297 S |
| 4,829,871 | 5/1989 | Manson | 84/297 S |
| 4,872,388 | 10/1989 | Gunn | 84/297 R |

FOREIGN PATENT DOCUMENTS 2226910 11/1990 United Kingdom .

*Primary Examiner*—Michael L. Gellner
*Assistant Examiner*—Patrick J. Stanzione
*Attorney, Agent, or Firm*—Barnes & Thornburg

[57] ABSTRACT

A termination having a body with a passage therein which defines a bend having an edge such that deformation of at least a first portion of the passage upstream of the edge secures the string to the body. The passage includes an entry portion which is symmetrical to the body so that string forces do not create unbending rotation.

25 Claims, 1 Drawing Sheet

TERMINATION FOR STRINGS OF A MUSICAL INSTRUMENT

This is a continuation of application Ser. No. 821,068, filed Jan. 16, 1992, now abandoned.

BACKGROUND AND SUMMARY OF INVENTION

This invention is a termination with single, dual, plural, or complex passages for capturing and terminating the string of a stringed musical instrument.

The standard termination for a steel guitar string is a small bead shaped like a pulley. The string is looped around the pulley slightly over one-half turn and then twisted with itself. This string termination is not as strong as the string, and it also creates tuning problems in a tremolo bridge, as discussed by Smith in U.S. Pat. No. 4,453,443.

This basic twist design has been strengthened by Ball in U.S. Pat. No. 4,581,976 with a wrap over the twist and by Manson in U.S. Pat. No. 4,829,871 by adding an extra piece of string just in the twist and bead area. A reinforced end loop is also shown by Kosmis in U.S. Pat. No. 2,535,143.

Smith in U.S. Pat. No. 4,453,443 proposed a termination with a single passage with multiple turns of the string. Stone and Allmansberger disclosed in U.S. Pat. No. 4,164,806 a bead with a single rough hole.

Manson in British Patent GB 2,226,910 discloses a molded or welded bead which incorporates a bent string. An S shaped string similar to that shown in the Manson British Patent results from inserting the string into a tube and crimping the tube as illustrated by Chaffee, et al. in U.S. Pat. No. 3,777,613.

A U shaped structure which allows merely wrapping a wire string thereabouts to form an anchor termination is illustrated by Coupe in U.S. Pat. No. 2,753,749.

The steel cable arts not related to the musical instrument include a two-piece socket and wedge cable termination. The cable goes into the straight side of the socket, around the large end of the wedge, and back out the socket on the tapered side.

The object of the present invention is to provide a termination for a string instrument which is inexpensive to manufacture and easy to assemble.

Another object of the present invention is to provide a termination for a string of a musical instrument wherein the weakest point of the string is not at the termination.

A further object of the present invention is to eliminate the twist lock and associated problems of the prior art.

A still further object of the present invention is to provide a termination where the string begins to vibrate as close as possible to the termination.

These and other objects are achieved by providing a termination having a body with a passage therein which defines a bend having an edge between a first and second portion. Deformation of at least the first portion of the passage secures the end of the string traversing the passage up stream from the edge. Preferably the first and second passages are through passages in the body with their second ends being displaced such that the edge is formed by the string bending about a portion of the body between the two displaced ends. The first and second portions or the through passages maybe coplanar or non-coplanar. The passage may be one continuous passage having first and second portions or maybe two through passages wherein the string would traverse the exterior of the body. Preferably the passage where the string enters the termination is linear and symmetrical with respect to the body. This restricts or prevents rotation of the body and therefore unbending of the crimped string. The first or second portions or passages maybe separated or joined at their first ends. Although the passage or passages may be formed in a single body, a two piece body may also be used.

One method of forming a terminated string for a musical instrument would included forming a passage in a first surface of a termination body. This is followed by inserting the first end of the string into the passage and exiting at least the first end of the passage. Finally, the body is crimped substantially parallel to the surface to secure the string to the body. The passage formed is one of those previously described.

Other objects, advantages and novel features of the present invention will become apparent from the following detailed description of the invention when considered in conjunction with the accompanying drawings.

BEST MODES FOR CARRYING OUT THE INVENTION

Figure 1:
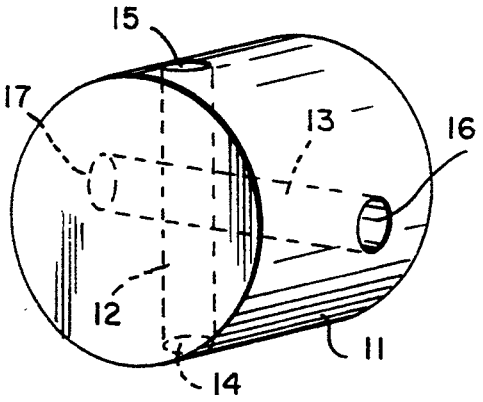
FIG. 1 is the perspective view of a first embodiment of a termination for a string of a musical instrument.

FIG. 1 is the preferred embodiment. The body 11 is a cylinder having generally a one-eighth inch diameter and length. It has two radial, non-intersecting non-coplanar through passages 12 and 13. The passages have spaced first ends 14 and 17 and spaced second ends 15 and 16 respectively.

Figure 2:
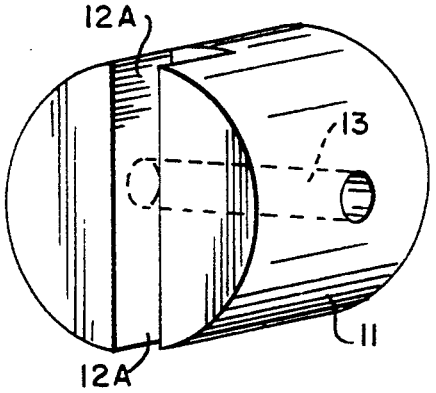
FIG. 2 is modification of the termination of FIG. 1.

FIG. 2 shows a modification of FIG. 1 wherein one of the through passages 12A is a slot in the face of the body 11.

Figure 3:
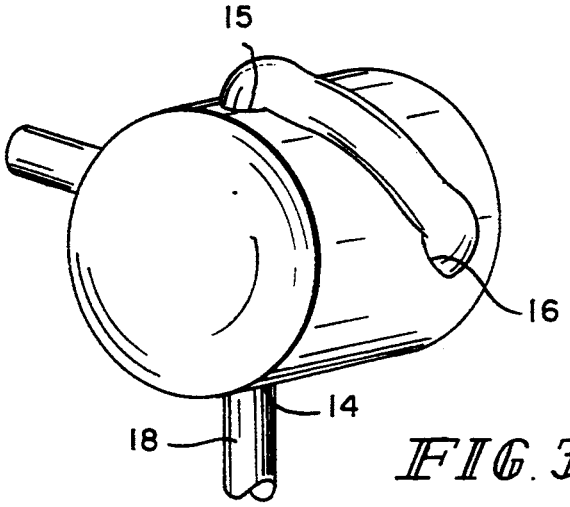
FIG. 3 is a perspective view of string mounted into the termination of FIGS. 1 or 2.

FIG. 3 shows the body crimped around a string 18. The string 18 goes through one passage 12 and bends around the body 11 and through the other passage 13. The body is then crimped to secure the body to the string. The end of the string 18 need not pass totally through passage 13.

The path of the string 18 could be considered a continuous passage having a first portion 13 connected to a second portion 12 by the exterior portion of the string between displaced second ends 15 and 16 of the passages 12 and 13 respectfully. Although crimping of the body 11 secures the string to the body by deformation of the walls without deforming the configuration of the passage, only the passage 13 needs be crimped. This secures the end prior to or up stream of the bend at either of the ends 15 or 16 of the string.

It should also be noted that the entry or through passage portion 12 is a radial passage and therefore symmetrical to the body. Thus any forces along this passage do not create a rotation of the body 11. Thus the forces produced by the tension of the string do not act to undo the crimping of the body and therefore the string is held secure to the body. FIG. 3 is the configuration appropriate to FIG. 1 and 2, the only difference being that a small line would occur in the face of the body 11 wherein the recess 12A had been crimped closed.

The passage entrances, which define the edge referred to herein, preferably have a chamfer to avoid nicking the string and thereby creating a weak spot in the string. The body shape is not critical and may be spherical or hemispherical instead of cylindrical. A flat may be provided on the curved surface to allow alignment of the passage for automated string insertion.

The bead of FIG. 2 for a 0.009 inch diameter high E string has a 0.020 inch hole centered 0.040 from the edge and a 0.020 inch wide slot that is 0.050 inch deep. This leaves about 0.025 inches of material between the two passages. The body is preferably brass.

Figure 4:
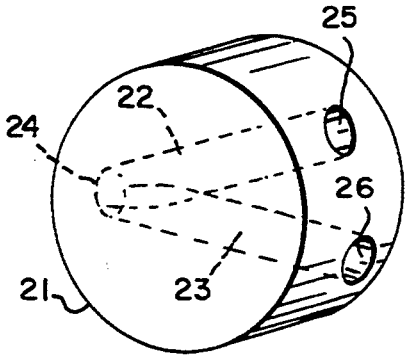
FIG. 4 is a perspective view of a second embodiment of a termination.

Whereas the embodiment of FIGS. 1–3 show two passages or passage portions in displaced parallel planes having both their ends displaced, FIG. 4 shows an embodiment where the passages are in a common plane having a common first end and a displaced second ends. A body 21 has passages 22 and 23 having a common first end 24 and displaced second ends 25 and 26. The string is inserted through 24 exiting 25 extending around the body and reinserted into 26. The end of the string then traverses 23 exiting again out of 24. Once the string has been inserted, the body is crimped to secure the string to the body. Preferably the passage 22 includes a small radial linear portion such that the string exiting 24 does not produce any rotating force on the body 21. The displaced ends 25 and 26, even though they are in the same plane, still include the desired bend between the securement at the passage 23 and the remainder of the string in the body 21.

Figure 5:
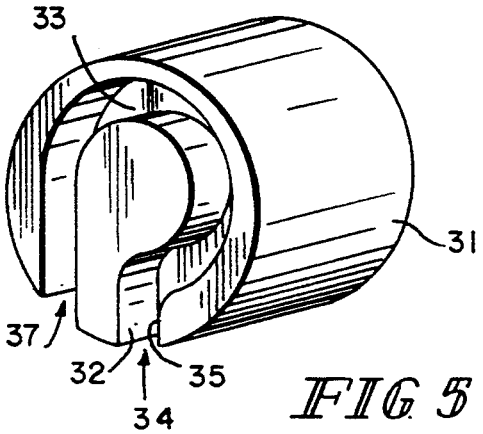
FIG. 5 is a perspective view of a third embodiment of a termination.

Although the embodiments of FIGS. 1–4 illustrate two through passages where the ends are displaced, FIG. 5 illustrates another embodiment having a continuous curved passage. The body 31 includes a first linear portion 32 along the radius or symmetrical with respect to body 31 and connected to a second passage portion 33 at a bend 35. The entrance to the passage 32 is at 34 and the exit of passage 33 is at 37. The change of radius or the bend 35 between the passages 32 and 33 produce the bend and edge equivalent to that at ports 15 and 16 or 25 and 26 of FIGS. 1, 2, 3 and FIG. 4 respectively. Once the string is inserted through port 34 into passages 32 and 33, the body 31 is crimped.

The passages 32 and 33 in the body 31 may be formed by machine into the face of the body 31. The crimping preferably is transverse the longitudinal axis of the body 31 or parallel to the face in which the passage has been formed. As an alternative to machining the passage, body 31 may be a thinner disk shape wherein the passages 32 and 33 are formed by swedging or upsetting into the face. This followed by inserting the string and applying a force transverse to the face to crimp the string. Since the passage forming operation and the crimping operation may occur in the same machine, orientation of the passage for automatic insertion of the wire is eliminated.

As a combination of FIGS. 1 and 5, two linear, parallel through passages may be formed in the face wherein at least one of the passages is symmetrical with respect to the body. Therefore the string would extend in through the symmetrical portion around the exterior outside of the body and then into the second non-symmetrical linear passage. This variation is not illustrated.

Figure 6:
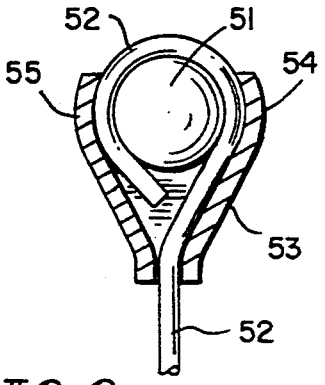
FIG. 6 is a cut-away view of a fourth embodiment of a termination.

FIG. 6 shows a two-piece termination in cross-section. Cylinder 51 is a core wrapped inside string 52 and ferrule 53 is crimped over the string and the cylinder. The string is crimped in areas 54 and 55 which are diametrically opposed and exits a radial or symmetrical portion 56 of the ferrule 53. This structure also requires the string under tension to pull out of a crimp from around a bend, which it cannot do. This structure also has two passages for the string at 54 and 55 separated by a string bend region.

FIG. 6 may also be done with 51 being a ball and ferrule 53 accommodating a sphere instead of a cylinder.

There are many variations bead shape and size as there are ways of creating dual or a plurality of passages or as there are complex passages. The basic theme is a string held by a combination of one or more of crimping forces, bending forces and restraint of rotational forces.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A termination to be affixed to a string of a musical instrument comprising:

a body;

a passage having first and second non-coaxial portions in said body and separated by a third portion which defines a bend having an edge prior to receiving a string; and at least said first portion of said passage being capable of being deformed for securing to said termination an end of a string, which traverses said passage from said first portion to said second portion via said third portion, at said first portion up stream from said edge.

2. A termination according to claim 1 wherein said first and second portions of said passage are coplanar.

3. A termination according to claim 1 wherein said first and second portions of said passage are non-coplanar.

4. A termination according to claim 1 wherein the walls of said first portion of said passage are deformable without modifying the path of said passage to secure said string to said termination.

5. A termination to be affixed to a string of a musical instrument comprising:

a body;

a passage having a first and a second non co-axial portion in said body and separated by a third portion for receiving a string which traverses said passage from said first portion to said second portion via said third portion; and said first and second portions of said passage being in displaced parallel planes.

6. A termination according to claim 5 wherein at least one of said portions of said passage is symmetrical to said body.

7. A terminated string of a musical instrument comprising:

a termination body including a first and a second through passage having first ends and being separated at least at their respective second ends;

a string extending through said second passage from its first end to its second end, around said body and into said first passage through its second end; and said string being secured to said body at least in said first passage.

8. A terminated string according to claim 7 wherein said string extends through said first passage and out its first end.

9. A terminated string according to claim 7 wherein said string is secured to said body at said first and second passages by crimping of said body.

10. A terminated string according to claim 7 wherein said first and second passages are linear.

11. A terminated string according to claim 7 wherein said first and second passages are coplanar.

12. A terminated string according to claim 7 wherein said first and second passages are non-coplanar.

13. A terminated string according to claim 7 wherein said first and second passages are separated at their respective first ends.

14. A terminated string according to claim 7 wherein said first and second passages are joined at their respective first ends.

15. A terminated string according to claim 7 wherein at least said second passage is symmetrical to said body.

16. A method of forming a terminated string for a musical instrument comprising:

forming a passage having a bend between two non-coaxial portions, open substantially along its length and in a first surface of a termination body;

inserting a first end of a string in said passage and exiting at least a first end of said passage; and crimping said body to secure said string to said body.

17. A method according to claim 16 wherein forming said passage includes forming a first linear portion extending from said first end of said passage symmetrical to said body.

18. A termination to be affixed to a string of a musical instrument comprising:

a body; and a passage in said body having a first linear portion symmetrical with respect to said body and extending from an inlet and a bend which connects said first portion to the remainder of said passage which is not coaxial with said first linear portion.

19. A termination according to claim 18 wherein said body includes a plurality of string termination components and said passage is formed between said components as assembled.

20. A terminated string of a musical instrument comprising:

a string;

a body;

first and second non-coaxial through passages each having first and second exterior ends in said body and at least separated at their respective first ends;

said string traversing said first passage to said second passage through said first ends; and said body being crimped to secure said string.

21. A terminated string according to claim 20 wherein said first and second passages are linear.

22. A terminated string according to claim 20 wherein said first and second passages are coplanar.

23. A terminated string according to claim 20 wherein said first and second passages are non-coplanar.

24. A terminated string according to claim 20 wherein said first and second passages are separated at their respective second ends.

25. A terminated string according to claim 20 wherein said first and second passages are joined at their respective second ends.

* * * * *